US006796431B1

(12) United States Patent
Goldring

(10) Patent No.: US 6,796,431 B1
(45) Date of Patent: Sep. 28, 2004

(54) COSMETICS PACKAGE

(75) Inventor: Judith Ann Goldring, Winchester (GB)

(73) Assignee: Mobile Make-Up Limited, Hampshire (GB)

( * ) Notice: Subject to any disclaimer, the term of this patent is extended or adjusted under 35 U.S.C. 154(b) by 190 days.

(21) Appl. No.: 10/130,551

(22) PCT Filed: Nov. 17, 2000

(86) PCT No.: PCT/GB00/04398

§ 371 (c)(1),
(2), (4) Date: May 16, 2002

(87) PCT Pub. No.: WO01/35790

PCT Pub. Date: May 25, 2001

(30) Foreign Application Priority Data

Nov. 19, 1999 (GB) ..... 9927437
Apr. 17, 2000 (GB) ..... 0009496

(51) Int. Cl.[7] ..... B65D 71/00

(52) U.S. Cl. ..... 206/581; 206/823; 132/297; 132/318

(58) Field of Search ..... 206/1.5, 581, 235, 206/823; 132/294, 295, 297, 301, 318

(56) References Cited

U.S. PATENT DOCUMENTS 2,465,946 A 3/1949 Velez
2,547,971 A * 4/1951 Polin et al. ..... 132/297
2,553,348 A 5/1951 Zurndorfer
4,562,923 A * 1/1986 Katada et al. ..... 206/581
4,589,430 A 5/1986 Sussman
4,815,608 A 3/1989 Silberberg
5,135,012 A 8/1992 Kamen et al.
5,301,808 A 4/1994 Pierson
5,318,053 A * 6/1994 Barnhart ..... 132/297
5,586,653 A * 12/1996 Taveroff ..... 206/581
5,715,848 A 2/1998 Conley, Jr.

FOREIGN PATENT DOCUMENTS

GB 2 126 890 A 4/1984

* cited by examiner

*Primary Examiner*—Luan K. Bui
(74) *Attorney, Agent, or Firm*—Stephen H. Eland; Dann, Dorfman, Herrell and Skillman

(57) ABSTRACT

A cosmetics package (1) comprising a base unit (2) having upper storage means (5), lower storage means (6*a*–6*h*) and side walls (8*a*, 8*b*), and a lid (3) movable relative to the base unit (2) between open and closed positions, the upper storage means (5) having locating means (11–14, 11*b*) for locating a plurality of first cosmetics products (11*a*–14*a*, 11*c*) in defined positions which are readily accessible when the lid (3) is in its open position but which are inaccessible when the lid (3) is in its closed position, the lower storage means (6*a*–6*h*) comprising a plurality of cavities opening into the, or at least one of the, side walls (8*a*, 8*b*) and extending beneath the upper storage means (5) for receiving second cosmetics products (7*a*–7*g*). The cosmetics package enables individual cosmetics products to be accessed easily for immediate application to a user.

22 Claims, 5 Drawing Sheets

COSMETICS PACKAGE

TECHNICAL FIELD

This invention relates to a cosmetics package comprising a cosmetics container and cosmetics products contained therein.

BACKGROUND ART

In the comfort of her own home a woman will generally apply her make-up at the same place, for example whilst seated at a dressing table in her bedroom. All the required cosmetics products can be placed on the dressing table so as to be within easy reach of the user. Since the working surface of a dressing table is flat and relatively large there is not a general need for the cosmetics products to be small in size or to be capable of being stored together in a make-up bag or the like.

When away from the home environment the make-up requirements of a woman are different. She may need to apply her favourite cosmetics products rapidly, several times a day and often in inconvenient locations, such as whilst travelling in a car, or taxi or on public transport. To meet these requirements a woman will generally carry her personal cosmetics products in a handbag or in a separate pouch (a make-up bag) within her handbag. However it is often difficult to locate the required cosmetics product within the handbag or make-up bag rapidly especially when other personal items are also carried in the handbag. In addition conventional cosmetics products may be difficult to access and use especially if the user is performing another task at the same time, e.g. waiting at a traffic light whilst driving a car. The shape of cosmetics products, e.g. tubular lipsticks, highlighter pencils and the like, renders the cosmetics products liable to fall off a surface on which they are placed unless the surface is flat and still—a requirement which may be difficult to fulfil whilst travelling in a car or train for instance. Furthermore, conventional cosmetics products intended primarily for use in the home environment are relatively large with each product having its own packaging some of which is intrinsic to the product's use and some of which is protective. Thus a relatively large handbag is required to carry a full complement of cosmetics' products. Furthermore some conventional cosmetics products require protective outer packaging, e.g. caps on lipsticks and pencils, which need to be stored whilst the product is in use. There is thus a need for a cosmetics package which carries a woman's favourite cosmetics products, is intended to be used away from the user's home environment and in transit and which allows cosmetics products to be accessed quickly, individually and easily.

There are cosmetics packs on the market where different cosmetics products, for example, blushers, eyeshadows, highlighters and powder, are packaged together. By reducing packaging in this way, the bulk of the cosmetics products that a woman has to keep in her make-up bag can be reduced. Some of these multi-purpose cosmetics packs are sold in such a way that the woman chooses the colours which are placed in the outer packaging. This custom-made multipurpose idea is more common among top of the range cosmetics houses and the outer packaging is usually of high quality. Although some of the extraneous packaging is eliminated, these known cosmetics packs assemble together standard cosmetics products. Since the cosmetics products that any woman uses are highly personalised and are sold in unnecessarily large sizes, none of these known cosmetics packs is able to contain all the cosmetics products that a woman needs to make herself up from scratch in a container which minimises packaging, allows easy individual access and is capable of being used in transit.

It is also known to provide a wallet containing replaceable folders in which cosmetics products are mounted. By suitable purchases of the required folders, such wallets can be personalised to contain all the make-up products a woman needs. However, this product is bulky since it has to cater for a large number of folders being fitted in the wallet and is also relatively flimsy. Again the cosmetics products are often standard ones and no saving in space is obtained by assembling them together.

One known cosmetics organiser which attempts to address the problems relating to the application of cosmetics products away from the home environment is disclosed in U.S. Pat. No. 5,301,808. This known cosmetics organiser has an upper storage means provided with recessed locating means, in the form of trays, for receiving cosmetics products and lower storage means, in the form of cavities, for receiving further cosmetics products. The individual trays of the upper storage means are not intended to conform precisely to the shapes of particular cosmetics products and the latter are not therefore gripped by the walls of the trays. This means that if the cosmetics organiser is accidentally dropped, the contents of the trays will be emptied. Furthermore this known cosmetics organiser uses generally standard, full-size cosmetics products and does not fully cater for the need to provide a compact package which allows a user to access each cosmetics product separately whilst retaining the remaining cosmetics products securely in their stored positions. The cosmetics organiser obliges the user to find means of temporary storage for the caps of certain cosmetics products, such as lipsticks or eye pencils, when those products are in use and such storage may not be readily available when the cosmetics organiser is being used in transit. The cosmetics organiser also does not provide a full range of cosmetics products.

DISCLOSURE OF THE INVENTION

A primary object of the present invention is to provide a cosmetics package which overcomes the disadvantages of the prior art.

It is an object of the invention to provide a portable cosmetics package containing specially sized and minimally packaged products which is able to cater for all of a user's cosmetics needs particularly when the user is away from the home environment.

A further object of the invention is to provide a cosmetics package which can be held by a user in one hand whilst allowing individual cosmetics products to be accessed and used with the user's other hand, any cosmetics product not being used being securely retained in position within the cosmetics package.

A further object of the invention is to minimise the amount of packaging needed for the proper use and protection of the cosmetics product thereby reducing the bulk of what is carried.

A still further object of the invention is to provide a cosmetics package for a plurality of cosmetics products in which some of the protective packaging of at least some of the cosmetics products is provided by the cosmetics package itself thereby obviating the need for a make-up bag.

According to the present invention there is provided a cosmetics package as claimed in the ensuing claim 1.

The wall means defining each cavity may serve as a cap for the associated second cosmetics product. On withdrawing a second cosmetics product from its associated cavity, the "cap" is thus effectively "removed" from the second cosmetics product rendering it ready for immediate application to the body, e.g. face, of a user. In this way a user holding the cosmetics package in one hand can access with the other hand any second cosmetics product for immediate use without having subsequently to remove a separate top or cap associated with the second cosmetics product.

Preferably the locating means comprises recessed regions for receiving and locating in position appropriately sized cosmetics products. The cakes of powdered material may be contained in open-topped containers received in said recessed regions. Such open-topped containers are releasably retained in position by any conventional retaining means. For example, a container containing a cake of powdered material may be received in an interference fit in its associated recessed region or may be magnetically retained therein. It is intended that the open-topped containers should only be replaced when they need to be replaced.

Preferably the lid is hinged to the base unit. Conveniently the lid has a mirror on its inner surface.

Preferably the first cosmetics products include a face powder, e.g. pressed face powder, with a puff applicator. The face powder may be contained in a lidded container received in an appropriate locating means. The puff applicator is intended to be received within the container, on top of the pressed face powder, when the lid of the lidded container is closed. Alternatively, however, the face powder may be contained in an unlidded container, a separate lid or cover being hinged to the upper storage means and being closeable to cover the unlidded container and powder therein and the covering puff applicator.

Preferably the applicators are releasably retained in position in the locating means by being resiliently gripped by walls of the recessed locating means. Thumb and finger recesses may be provided to facilitate gripping and removal of the applicators from their stored positions.

Preferably each wall means defining a cavity has retaining means associated therewith for releasably retaining an associated second cosmetics product within the cavity. For example, the retaining means may cooperate with retention means on the second cosmetics product when the latter is fully positioned in the cavity. In this case the cooperating retaining means and retention means may comprise cooperating screw-threaded portions or cooperating detent means with an end of the second cosmetics product closing the cavity in its retained position within the cavity.

The second cosmetics products comprise cosmetics which can be applied directly to the face of the user once the product has been removed from its cavity. Examples of such cosmetics products are eyeliner, eyebrow pencils, lip pencils, lipstick and foundation. Also included in the second cosmetics products is mascara with the mascara applicator brush being considered an integral part of a mascara cassette. In particular, the mascara-containing container of the mascara cassette may be arranged to be releasably retained in the cavity for the mascara cassette. The mascara brush, normally received in the mascara-containing container, can then be screwed into and removed from the mascara-containing container in a conventional manner. With this arrangement, the mascara is easily accessible, the user being able to hold the cosmetics package in one hand so as to be able to use the mirror and have access to the mascara and to use the mascara applicator brush with the other hand.

Preferably the cosmetics package is provided with a sharpener to enable the eyeliners and "pencils" to be sharpened when required. Preferably the sharpener will be releasably secured in one of the said cavities. A "pencil", if required to be sharpened, can be withdrawn by a user with one hand from its cavity and inserted into the sharpener whilst the cosmetics package is held with the other hand. The user is able to sharpen the "pencil", to remove it from the sharpener, (optionally) to use the "pencil" and finally to replace it in its cavity whilst still holding the cosmetics package. Ideally the sharpener and mascara cassette are received in cavities of similar cross-sectional size in opposite side walls of the container. This allows the mascara cassette to be positioned on the right- or left-hand side of the container depending on the requirements of the user, usually whether the user is right- or left-handed.

Conveniently the said cavities are formed in opposite side walls of the base unit.

BRIEF DESCRIPTION OF THE DRAWINGS

Embodiments of the invention will now be described, by way of example only, with particular reference to the accompanying drawings, in which.

BEST MODE FOR CARRYING OUT THE INVENTION

Figure 1:
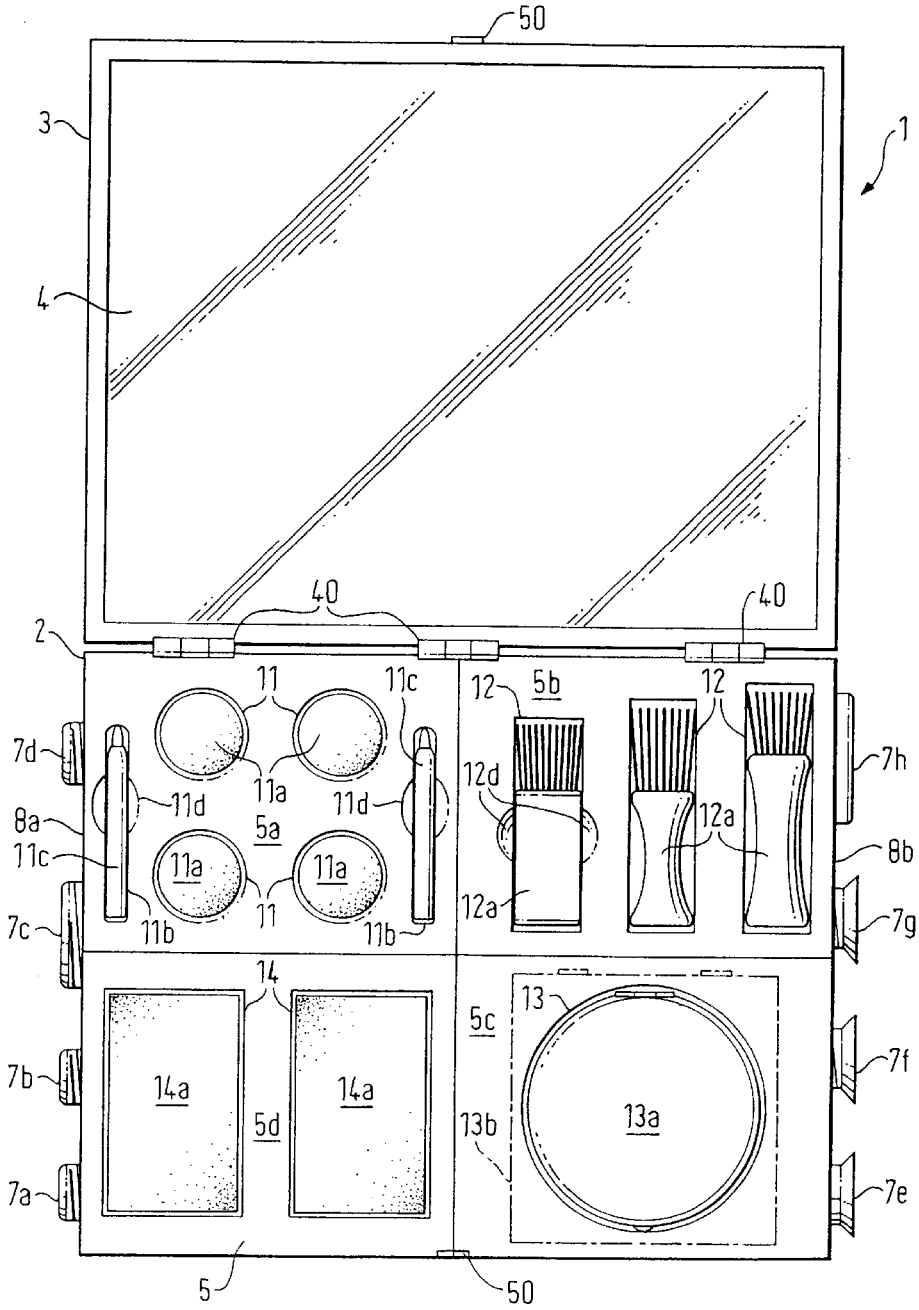
FIG. 1 is a schematic view from above of a cosmetics package according to the invention including a base unit and lid which is in an open position to reveal first cosmetics products received in upper storage means.
Figure 2:
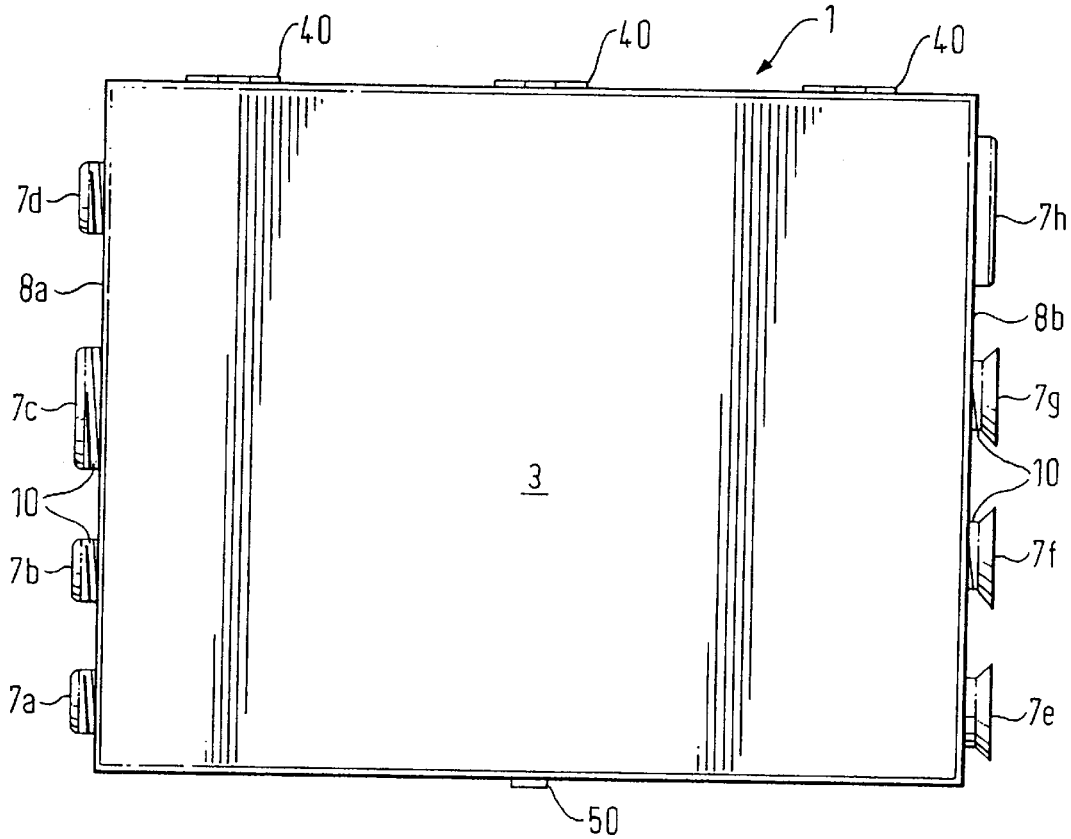
FIG. 2 is a view from above of the cosmetics package shown in FIG. 1 but with the lid shown in a closed position.
Figure 3:
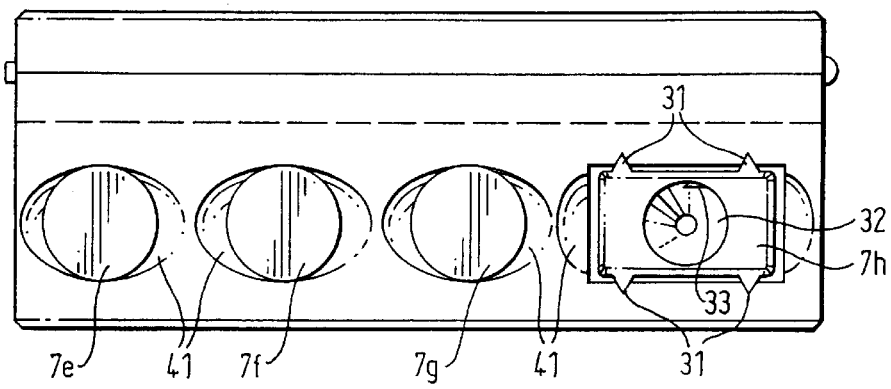
FIGS. 3 and 4 are views from opposite ends, respectively, of the cosmetics package shown in FIG. 2.
Figure 4:
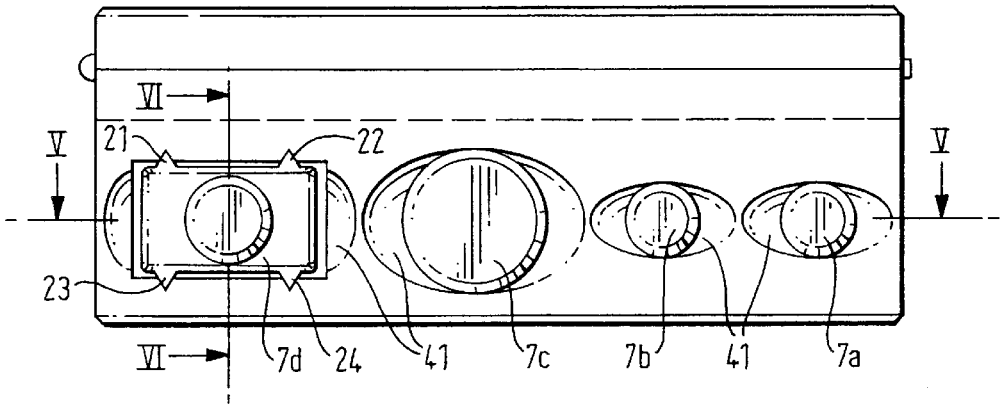

The drawings show a cosmetics container, generally designated by the reference numeral 1, having a generally rectangular, box shaped base unit 2 and a lid 3 hinged by hinges 40 along one side of the base unit 2 for movement between an open position (see FIG. 1) and a closed position (see FIG. 2). In FIG. 1 the lid is shown opened through 180° although in practice the maximum opening may be limited, e.g. to from 100° to 150°, e.g. 120°, relative to the base unit 2. The lid has a mirror 4 on its inner surface which is revealed when the lid is in its open position. The container has a catch 50 for securing the lid 3 in its closed position. Although not shown, the lid 3 may have walls which cover the sides of the base unit 2 when the lid is in its closed position.

The base unit 2 has upper and lower storage means for storing cosmetics products. The upper storage means is conveniently in the form of one or more moulded plastics tray 5 having locating means, in the form of recessed portions 11–14, for locating different first cosmetics products. As shown in FIG. 1, four separate moulded trays or tray parts 5*a*–5*d* are removably fixed in position and can, if required, be exchangeably positioned. In the embodiment shown, tray part 5*a* has four circular recessed portions 11 for storing cakes 11*a* of (pressed) powdered products, such as eyeshadows, a highlighter and concealer, and two rectangular recessed portions 11*b* for receiving eyeshadow applicators 11*c* or the like; tray part 5*b* has three rectangular recessed portions 12 for storing brushes 12*a*; tray part 5*c* has a circular recessed portion 13 for receiving a cassette 13*a* containing pressed face powder; and tray part 5*d* has two rectangular recessed portions 14 for storing cakes 14*a* of blushers or a blusher and shaper. It will be appreciated, however, that the particular lay out for the cosmetics products can be varied as required. The upper storage means should, however, locate the various cosmetics products in their correct positions; prevent the cosmetics products from moving from their located positions when the lid 3 is closed; and allow the cosmetics products to be removed from their located positions in the tray 5 when the lid is open.

As can be seen in FIG. 1, each recessed portion 11*b* is similar in shape to its associated eyeshadow applicator 11*c* and each recessed portion 12 is appropriately sized to receive in gripping relationship its associated brush 12*a*. In particular the eyeshadow applicators 11*c* and brushes 12*a* are conveniently resiliently retained in position by opposing walls of the recesses resiliently gripping the applicators and brushes. Access to the gripped applicators and brushes may be facilitated by the provision of finger/thumb recesses 11*d* and 12*d* associated with each or some of the brush/applicator receiving recesses. The "cakes" of cosmetics, i.e. the cakes 11*a* in the form of eyeshadows, highlighter and concealer and the cakes 14*a* in the form of blusher or blusher and shaper, are releasably retained in recesses so as to be flush with the top of the tray 5. The face powder cassette 13 *a* shown is a separate device typically of conventional design (but possibly of smaller size). The cassette 13a has a cylindrically shaped container for the pressed face powder and a lid hinged thereto. A puff applicator (not shown) is intended to be located on top of the powder in the container for face application of the pressed powder. Although less preferred, it is alternatively possible to have a separate lid 13*b* (shown in chain lines in FIG. 1) hinged directly to the tray 5 instead of the lid being hinged to the container. Each of the cosmetics products 11*a*–14*a* and 11*c* is intended to be replaceable when empty (for products 11*a*, 13*a* and 14*a*) or worn out (for products 11*c* and 12*a*). The powdered products are releasably retained within their recessed portions by any known conventional means to allow easy replacement when required. By way of example only, the products are typically retained in open topped, cylindrical or rectangular containers which may be magnetically retained in position or frictionally held in position in their recessed portions. If a powdered product needs to be replaced, either because the product has been fully used or because the user wishes to change the colour or type of product stored, the open-topped container is simply removed from its associated recessed portion and a new or replacement container containing the desired, e.g. replacement, powdered product is retained within the recessed portion.

The lower storage means comprises a number of cavities 6*a*–6*d*, closed at their bottom ends and opening into one end wall 8*a* of the base unit 2, and a number of cavities 6*e*–6*h*, closed at their bottom ends and opening into an opposite end wall 8*b* of the base unit 2. The cavities 6*a*–6*h* are sized to receive different second cosmetics products 7*a*–7*h*, respectively (see FIG. 5). In the embodiment shown, references 7*a* and 7*b* designate lipsticks; reference 7*c* designates a "foundation" tube; reference 7*d* designates a mascara cassette; reference 7*e* designates eyeliner; reference 7*f* designates an eyebrow pencil; reference 7*g* designates a lip pencil; and reference 7*h* designates a sharpener for the eyebrow pencil 7*f* and/or the lip pencil 7*g*. The cosmetics products 7*a*, 7*b* and 7*e* to 7*g* all comprise "sticks" of cosmetics material having an uncapped end. In other words these products are not provided with caps or tops which need to be removed when the products are removed from their cavities in order for the cosmetics material to be applied to the face of the user. Each of the lipsticks 7*a* and 7*b* may have a turnable shroud around the "stick" of cosmetics material turnable to cause the stick to be projected forwardly and rearwardly in a conventional manner. In the embodiment shown, the cavities 6*d* and 6*h* are similarly sized so that the sharpener 7*h* can be positioned in cavity 6*d* and the mascara cassette 7*d* can be positioned in cavity 6*h*. This allows the mascara cassette to be positioned on the right or left hand side of the cosmetics container depending on whether the user is right- or left-handed. It will be appreciated that in different designs other cavities may be similarly sized to enable different cosmetics products to be stored in alternative cavities. Also cosmetics products may be received in differently sized and positioned cavities. The foundation tube 7*c* has a non-removable top which can be turned in opposite directions between an open position allowing foundation to be squeezed from the flexible foundation tube and a closed position. By way of example only, the foundation tube has an externally screw-threaded neck in which a nozzle is received. The nozzle comprises a central spigot surrounded by openings. The top is screw-threadedly connected to the neck and has a central orifice. In the closed position of the top, the spigot of the nozzle is received in the central orifice so that foundation cream cannot exit. On turning the top, the top moves axially away from the nozzle so that the spigot is withdrawn from the central orifice. On squeezing the foundation tube, the flowable foundation cream is able to pass through the nozzle openings and through the now-open central orifice in the top. In an alternative, but less preferred, design the foundation tube 7*c* instead of having an openable and closeable "twist" top or cap may be provided with a non-removable flip open cap hinged to the neck of the tube.

Figure 5:
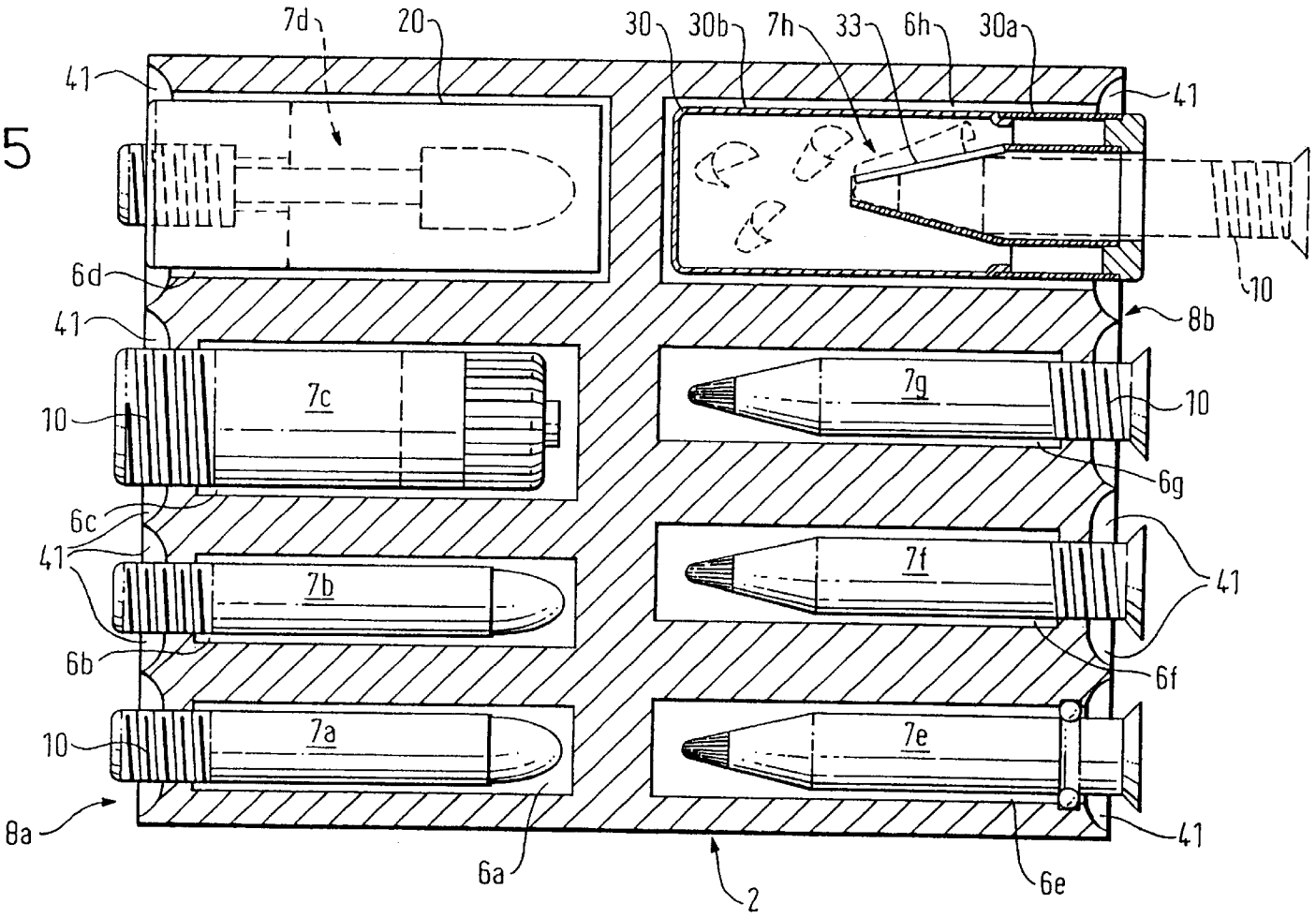
FIG. 5 is a schematic sectional view of the cosmetics package taken on the line V—V of FIG. 4.

The cosmetics products 7*a*–7*h* are designed to be retained in fixed positions within, and yet be easily removable from, the cavities 6*a*–6*h*, respectively. It is particularly desirable for the cosmetics products to be individually accessed and used by a user with one hand whilst holding the cosmetics container with the other hand. This can be achieved by providing the ends of the second cosmetics products 7*a*–7*c* and 7*e*–7*g* with externally screw threaded portions 10 for screw threaded connection with screw threaded portions at the mouth of each corresponding cavity. It will be appreciated that the rear or threaded portion of each cosmetics product will have a slightly larger diameter than the front portion to enable the cosmetics product to be inserted through the screw-threaded mouth of its associated cavity before being screwed in position in the cavity. Instead of screw-threaded connections, the cavities 6*a* to 6*c* and 6*e* to 6*g* may have other first cooperating means which cooperate with other respective second cooperating means on the cosmetics products. For example, one of the cooperating means may comprise a projection, e.g. a resiliently mounted member such as a spring loaded ball or other element, and the other cooperating means may comprise a recess. FIG. 5 shows schematically screw threaded retention means for cosmetics products 7*a*–7*c* and 7*f*–7*g* and detent/recess type retention means for the cosmetic product 7*e*. In practice, however, it would be normal for only the same type of retention means to be used for any one cosmetics package. The use of screw-threaded retention means is preferred since this securely holds the cosmetics products in position within their cavities and, for those products that normally require caps, allows the caps to be dispensed with. This is because the wall of the cavity in which a product is received itself acts as the "top" of the cosmetics product retained therein.

Figure 6:
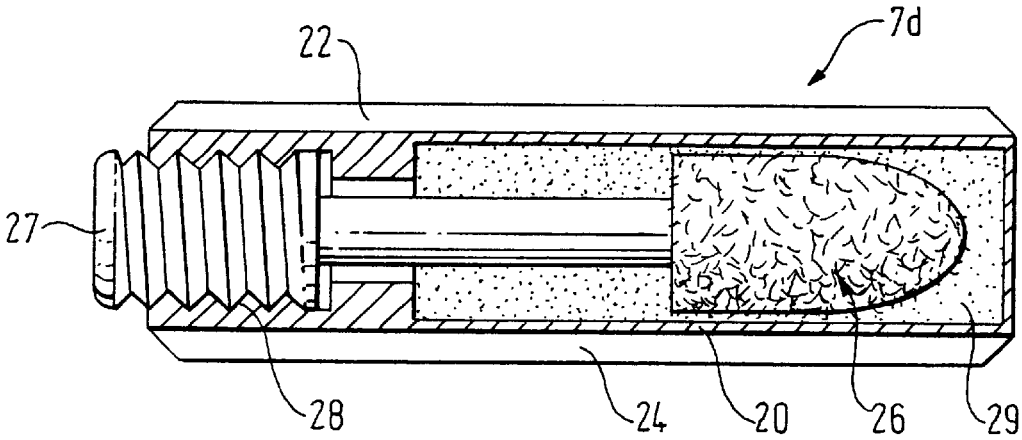
FIG. 6 is a cross-sectional view on an enlarged scale of a mascara cassette removed from the cosmetics package and taken on the line VI—VI of FIG. 4.

The mascara cassette 7*d* and sharpener 7*h* are designed differently from the other second cosmetics products. As shown in FIG. 6, the mascara cassette 7*d* has a generally rectangular section outer housing 20 which is slidably received in the similarly shaped cavity 6*d*. The housing 20 has small longitudinally extending ribs 21 and 22 on one face and 23 and 24 on the opposite face. The housing can be push-fitted into the cavity 6*d* with the ribs 21–24 being slidably received in and frictionally engaged with correspondingly shaped grooves in the walls of the cavity 6*d*. The applicator 25 of the mascara cassette has a brush 26 at one end and an externally screw threaded handle 27 at the other end. When in position in the mascara cassette, the handle 27 is screw threaded into an internally threaded recess 28 in the housing 20. The brush 26 is received in a mascara-containing cavity 29 within the housing. The applicator 25 can thus be removed by unscrewing it from the housing 20. The entire mascara cassette can be removed from the cavity 6*d* for replacement or, if required, to interchange its position with that of the sharpener 7*h*.

The sharpener 7*h* has an external housing 30 similar in cross-section to that of the housing 20 and has longitudinal ribs 31 which are received in correspondingly shaped grooves in the walls of the cavity 6*h* to enable the sharpener to be frictionally retained in the cavity. The sharpener has an opening 32 for receiving a "pencil" to be sharpened and a blade 33. The housing 30 may comprise, as shown, top and bottom portions 30*a* and 30*b*, respectively, which are detachably push-fitted together. By pulling the housing portions apart, "shavings" from sharpened pencils can be emptied. In this case the ribs 31 are conveniently only provided on the top housing portion 30*a*.

As an alternative to continuous longitudinal ribs 2124 on the housing 20 and continuous longitudinal ribs 31 on the housing 30, shorter ribs or two or more spaced apart ribs or projections could be provided which are frictionally and slidably received in the grooves of the respective cavity walls. In another alternative such ribs or projections could be provided on the cavity walls, with continuous groves formed in the walls of the housings 20 and 30.

As shown in the drawings, the end walls 8*a* and 8*b* may have recessed portions 41 at the mouth of each cavity 6*a*–6*h* to facilitate the removal of individual cosmetics products from the cavities. When in position the cosmetics products 7*a*–7*h* may protrude slightly from their respective cavities 6*a*–6*h*, as shown in the figures, to facilitate their removal although this is not essential especially if the recessed portions 41 are provided.

It is intended that replacement cosmetics products should be available for replacing used cosmetics products. It is not, therefore, necessary to purchase an entirely new cosmetics pack when the individual cosmetics products are used. It is also possible, of course, to purchase only those products, and those colours and shades of products, that a particular individual requires. Thus the contents of any particular cosmetics package, consisting of the cosmetics container 1 and the stored cosmetics products, can be customised to the user's requirements. The cosmetics products are generally of smaller size than stand-alone cosmetics products which enables a plurality of customised cosmetics products to be stored in a relatively small package. None of the cosmetics products has removable caps which need to be temporarily stored when the product in question is being used. Thus the cavities 6*a*, 6*b* and 6*e* to 6*g* themselves provide the "caps" or lids for the products 7*a*, 7*b*, and 7*e* to 7*g*, respectively.

The cosmetics package particularly described herein with reference to the drawings is a type of "compact" similar in shape to a rectangular powder compact and about four times its size in length and breadth and twice its size in depth. By way of example only, the cosmetics container 1 typically has external dimensions of 101 mm (4") by 76 mm (3") by 19 mm (0.75"). However, instead of being like a powder compact and holding just face-powder, the cosmetics container 1 is able to hold small quantities of virtually every cosmetic a woman needs in order to make herself up. It therefore provides a new way of keeping cosmetics together, replacing the make-up bag so that the user is able at a glance to see where each make-up item is. Because of the way in which the cosmetics products fit securely into the container, a user, when making-up her face, is able to select, use and put back in the correct position each cosmetics product as and when required. The cosmetics package is designed so that, while it is held in one hand, any cosmetics product can easily accessed and used with the user's other hand. Thus the cosmetics package can be used when and where required with the minimum of fuss and with the non-used cosmetics products being securely held in place during use of a cosmetics product.

The cosmetics package described herein puts together all the cosmetics products that a woman needs to make-up in a single convenient, cosmetics container which is small enough to go into a handbag. The cosmetics package can easily be accessed by a user holding the package in one hand and removing, using and replacing a cosmetics product with the other hand without the need to further "open" a removed cosmetics product to enable it to be applied. The cosmetics products which will go into the box may be available as replacement cosmetics products or "colour cassettes". Users will be able to purchase the empty cosmetics container 1 separately and choose the "colour cassettes" which they require. When the cosmetics are used up, or if the user just requires a new shade of cosmetics product, she buys a new cassette, takes out the old one and replaces it with the new one. To allow the container to carry sufficient cosmetics products, it is intended that the amount of cosmetic in each "colour cassette" should be less than the normal full size sold and will be shaped to fit into the slim base unit of the packaging. This is very different from present practice where women buy products from different manufacturers each of whom packages cosmetics in different ways each taking up space in a woman's make-up bag.

The main advantages to women of the cosmetics pack described herein are:

1) The method of packaging cosmetics products described herein allows a woman to carry with her in a convenient holder everything she needs to ensure that she looks her best during the day even if she has to leave the house "bare-faced". If she is going out in the evening, she can completely "re-do" her face without the need to carry bulky bottles and jars around all day.

2) All the required cosmetics products are stored in a single container.

3) The cosmetics package eliminates the use of a conventional make-up bag allowing cosmetics products to be stored in precise positions within a single cosmetics container.

4) The cosmetics package can be sold in many different designs and can better reflect a woman's personality or mood than a conventional make-up bag.

5) Because the cosmetics products are secured in the cosmetics package by secure mechanisms, e.g. screw-threads and closable lids, the contents of the box are secure in transit. It would thus be possible for a woman to do her make-up in a taxi, on the bus, plane or train.

6) A user can hold the cosmetics package in one hand and, with the other hand, remove and immediately use any stored cosmetics product without the need to remove a removable cap or lid from the removed cosmetics product and temporarily store it. At least some of the cosmetics products have exposed, uncapped "sticks" of cosmetics material. The walls of cavities in which these cosmetics products are stored themselves provide "caps" or "tops" for the products. On removal of such a cosmetics product from its cavity the exposed end of the stick of cosmetics material can be applied directly to the face of a user.

Industrial Applicability

The invention has industrial application in the manufacture of cosmetics products and containers.

What is claimed is:

1. A cosmetics package comprising a base unit having upper storage means, lower storage means and a pair of spaced apart side walls, and a lid movable relative to the base unit between open and closed positions, a plurality of first cosmetics products comprising cakes of powdered material, for applying the powdered material to the face, and a plurality of second cosmetics products including at least one uncapped cosmetics pencil, the upper storage means having locating means for locating said first cosmetics products in defined positions which are readily accessible when the lid is in its open position but which are inaccessible when the lid is in its closed position, the lower storage means comprising a plurality of wall means each defining a separate cavity extending beneath the upper storage means for receiving and removably securing in position said second cosmetics products, characterised in that the first cosmetics products are releasably retained in said locating means, in that said cavities are formed in both of said side walls, in that said second cosmetics products include one or more lipsticks having an uncapped end, whereby on removal of the or each lipstick from the cavity in which it is received the exposed uncapped end of the lipstick can be applied directly to the face of the user, and in that said at least one cosmetics pencil and said one or more lipstick are of smaller than standard size.

2. A cosmetics package according to claim 1, characterised in that said cavities are closed cavities some of which extend from one of said side walls and terminate before reaching an intermediate remainder of which extend from the other of said side walls and terminate before reaching the said intermediate plane between the side walls.

3. A cosmetics package according to claim 1, wherein said second cosmetics products includes a tube containing fluent material, and having an outlet nozzle, and a non-removable cap movable between open and closed positions to allow or prevent the fluent material being dispensed through the outlet nozzle.

4. A cosmetics package according to claim 1, characterised in that said second cosmetics products include a mascara product comprising a mascara container detachably received in a respective cavity and containing mascara and a mascara applicator brush removably received in the mascara container, whereby, on removal of the mascara applicator brush from the mascara container, mascara on the brush can be applied directly to the eyelashes of the user.

5. A cosmetics package according to claim 4, characterised in that said mascara container is slidably received in, and frictionally engaged with walls of, its associated cavity.

6. A cosmetics package according to claim 5, characterised in that said second cosmetics products includes a sharpener to enable at least some of said sticks of cosmetics material of said cosmetics means, to be sharpened.

7. A cosmetics package according to claim 6, characterised in that said sharpener is releasably secured in one of the said cavities.

8. A cosmetics package according to claim 6, characterised in that said sharpener is slidably received in, and frictionally engaged with walls of, its associated cavity.

9. A cosmetics package according to claim 8, characterised in that the cavities in which said mascara product and said sharpener are received have similar cross-sections and the external cross-sections of the mascara product and the sharpener are similarly shaped, whereby the mascara product and the sharpener can be received in either of the these two cavities.

10. A cosmetics package according to claim 1, characterised in that said second cosmetics products are each provided with first retaining means cooperable with second retaining means provided on said wall means for releasably retaining the second cosmetics products in their respective cavities.

11. A cosmetics package according to claim 10, characterised in that said first and second retaining means comprise interengaging screw thread means.

12. A cosmetics package according to claim 10, characterised in that said first retaining means comprises a recess in a circumferential portion of each second cosmetics product and in that the second retaining means comprises resilient, detent means.

13. A cosmetics package according to claim 1, characterised in that the lid is 1, hinged to the base unit.

14. A cosmetics package according to preceding claim 1, characterised in that the lid has a mirror on its inner surface.

15. A cosmetics package according to claim 1, characterised in that said locating means comprises recessed regions for receiving and locating in position appropriately sized ones of said first cosmetics products.

16. A cosmetics package according to claim 1, characterised in that said first cosmetics products also include a face powder means comprising a powder container received in one of said locating means, a puff applicator and a hinged lid closeable to enclose the puff applicator within the face powder container.

17. A cosmetics package according to claim 1, characterised in that said applicators are releasably retained in position in the locating means by being resiliently gripped by walls of the recessed locating means.

18. A cosmetics package according to claim 1, characterised in that thumb and finger recesses are provided to facilitate gripping and removal of the applicators from their stored positions.

19. A cosmetics package according to claim 1, characterised in that said cakes of powdered material are releasably retained in position by retaining means.

20. A cosmetics package comprising a base unit having upper storage means, lower storage means and a pair of spaced apart side walls, and a lid movable relative to the base unit between open and closed positions, a plurality of first cosmetics products comprising cakes of powdered material, for applying the powdered material to the face, and a plurality of second cosmetics products including at least one uncapped cosmetics pencil, the upper storage means having locating means for locating said first cosmetics products in defined positions which are readily accessible when the lid is in its open position but which are inaccessible when the lid is in its closed position, the lower storage means comprising a plurality of wall means each defining a separate cavity extending beneath the upper storage means for receiving and removably securing in position said second cosmetics products, characterised in that said first cosmetics products are releasably secured in position in said locating means, in that said cavities are formed in both of said side walls, and in that each, or part of each, of said second cosmetics products is received in its respective cavity in such a condition that when removed from the cavity it can be applied immediately to the face of the user.

21. A cosmetics storage unit comprising a base unit having upper storage means for storing first cosmetics products, lower storage means for storing second cosmetics products and side walls, and a lid movable relative to the base unit between open and closed positions, the upper storage means having locating means for locating the first cosmetics products in defined positions which are readily accessible when the lid is in its open position but which are inaccessible when the lid is in its closed position, the lower storage means comprising a plurality of wall means each defining a separate cavity, the cavities opening into a side wall and extending beneath the upper storage means for receiving and removably securing in position the second cosmetics products, characterised in that said cavities open into both of said side walls.

22. A cosmetics storage unit according to claim 21, wherein the wall means of at least some of said cavities have screw-threaded portions for screw threadedly retaining second cosmetics products in the cavities.

* * * * *